US008424580B2

(12) United States Patent
Anderson et al.

(10) Patent No.: US 8,424,580 B2
(45) Date of Patent: Apr. 23, 2013

(54) AUTO LAMINATION CASSETTE APPARATUS

(75) Inventors: Donald A. Anderson, Bellevue, WA (US); Gary E. Pfitzner, Issaquah, WA (US); Ronald E. Anderson, Renton, WA (US)

(73) Assignee: The Boeing Company, Chicago, IL (US)

( * ) Notice: Subject to any disclaimer, the term of this patent is extended or adjusted under 35 U.S.C. 154(b) by 253 days.

(21) Appl. No.: 12/901,982

(22) Filed: Oct. 11, 2010

(65) Prior Publication Data

US 2011/0030903 A1 Feb. 10, 2011

Related U.S. Application Data

(62) Division of application No. 11/829,536, filed on Jul. 27, 2007, now Pat. No. 7,811,401.

(51) Int. Cl.
*B32B 38/04* (2006.01)
*B32B 38/10* (2006.01)
*B32B 39/00* (2006.01)

(52) U.S. Cl.
USPC ..... 156/510; 156/765

(58) Field of Classification Search ..... 156/166, 156/169, 174, 184, 247–250, 267, 268, 289, 156/344, 391, 510, 537, 538, 584, 716, 765
See application file for complete search history.

(56) References Cited

U.S. PATENT DOCUMENTS

| | | | | |
|---|---|---|---|---|
| 3,996,089 | A | 12/1976 | More et al. | |
| 4,285,752 | A | 8/1981 | Higgins | |
| 5,402,962 | A | 4/1995 | Blaimschein | |
| 5,472,553 | A | 12/1995 | Roberts | |
| 5,480,508 | A | 1/1996 | Manabe et al. | |
| 5,866,272 | A | 2/1999 | Westre et al. | |
| 6,299,945 | B1 | 10/2001 | Mertz et al. | |
| 6,860,957 | B2 | 3/2005 | Sana et al. | |
| 7,013,943 | B2 | 3/2006 | Sana et al. | |
| 7,160,594 | B2 | 1/2007 | Wieck et al. | |
| 7,422,385 | B2 * | 9/2008 | Koeda et al. | 400/618 |

OTHER PUBLICATIONS

Chawla, Krishan Kumar, Composite Materials: Science and Engineering; Springer, 1998, 2nd Edition, p. 138.

* cited by examiner

*Primary Examiner* — Sing P Chan
(74) *Attorney, Agent, or Firm* — Yee & Associates, P.C.

(57) ABSTRACT

In one embodiment, an apparatus is provided for preparing a cassette spool. The apparatus includes: a supply reel for supplying and unrolling tape material on original backing paper; at least one cutting member for cutting unrolled tape material while on original backing paper; a cutting surface defined in a plane; a pivoting path member adapted to move from a first position aligned in the plane to a second position aligned at least partially out of the plane; at least one removing member for removing uncut unrolled tape material from original backing paper; and a cassette spool for rolling up unrolled cut tape material on original backing paper. In further embodiments, methods are provided for preparing a cassette spool with cut tape material on original backing paper.

20 Claims, 6 Drawing Sheets

AUTO LAMINATION CASSETTE APPARATUS

This application is a divisional of and claims priority to U.S. application Ser. No. 11/829,536 filed on Jul. 27, 2007 and entitled CASSETTE APPARATUS AND PROCESS, status allowed.

CROSS-REFERENCE TO RELATED APPLICATIONS

This application is related to U.S. Pat. No. 7,763,138 filed on May 21, 2007 and entitled AUTO LAMINATION CASSETTE APPARATUS AND PROCESS and U.S. application Ser. No. 12/828,543 filed on Jul. 1, 2010 and entitled AUTO LAMINATION CASSETTE APPARATUS, which in turn is a divisional of U.S. Pat. No. 7,763,138, the entire contents of which is expressly incorporated herein by reference.

BACKGROUND INFORMATION

Many apparatus and methods exist for automatically preparing cassette spools or reels wound with tape material on original backing paper or film. This prepeg tape material may be a composite, unidirectional tape which may be used to form a laminate. In one existing apparatus/method, tape material on backing paper is unrolled from a supply reel, the tape material is cut into the required configuration, removed from the original backing paper, and then transferred to another release backing paper and wound onto a cassette spool. However, the transferring of the tape material to another backing paper may create problems. The tape material may lose some of its tacking ability, may not align as well on the new backing paper, may not adhere well to the new backing paper, and may have placement problems when placed on a working surface. Further, the new backing paper may have a certain amount of stretch which may cause tension problems, may form wrinkles when the tape is placed onto a working surface, and/or may not allow good tacking of the tape material onto the working surface. This may cause problems with tape lifting from the working surface, or may cause wrinkles to be formed in the laminate being formed with the tape material. Moreover, the process of putting the tape material onto a new backing paper may require an excessive number of machines, may increase the costs, may increase the time required, may reduce efficiency, and/or may lead to one or more other problems.

An apparatus, and/or method for removing tape material from backing paper, is needed to decrease one or more problems associated with one or more of the existing apparatus and/or methods.

SUMMARY

In one aspect of the disclosure, a method is provided for preparing a cassette spool. In one step, a tape material on an original backing paper is unrolled from a supply reel. In another step, a portion of the unrolled tape material is cut on a cutting surface defined in a plane while the unrolled tape material is still on the original backing paper. In still another step, the cut portion of unrolled tape material is moved along a path member while retaining the cut portion of unrolled tape material on the original backing paper. At least a start portion of the path member is aligned in the plane. In yet another step, at least a portion of the path member is moved out of alignment with the plane to facilitate separation of an uncut portion of the unrolled tape material from the original backing paper. In an additional step, the uncut portion of the unrolled tape material is removed from the original backing paper. In another step, the cut portion of unrolled tape material still on the original backing paper is rolled onto the cassette spool.

In another aspect of the disclosure, an apparatus is provided for preparing a cassette spool. The apparatus comprises: a supply reel for supplying and unrolling tape material on original backing paper; at least one cutting member for cutting unrolled tape material while on original backing paper; a cutting surface defined in a plane; a pivoting path member adapted to move from a first position aligned in the plane to a second position in which at least a portion of the pivoting path member is aligned out of the plane, wherein the first position is for retaining a cut portion of unrolled tape material on original backing paper, and the second position is for facilitating separation of an uncut portion of unrolled tape material from original backing paper; at least one removing member for removing uncut unrolled tape material from original backing paper; and a cassette spool for rolling up unrolled cut tape material on original backing paper.

In a further aspect of the disclosure, an apparatus is provided for preparing a cassette spool. The apparatus comprises: a supply reel for supplying and unrolling tape material on original backing paper; at least one cutting member for cutting unrolled tape material while on original backing paper; a cutting surface defined in a plane; a curved path member adapted to move from a first position in which a start portion of the curved path member is aligned in the plane to a second position in which the start position of the curved path member is aligned out of the plane, wherein the first position is for retaining a cut portion of unrolled tape material on original backing paper, and the second position is for facilitating separation of an uncut portion of unrolled tape material from original backing paper; at least one removing member for removing uncut unrolled tape material from original backing paper; and a cassette spool for rolling up unrolled cut tape material on original backing paper.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
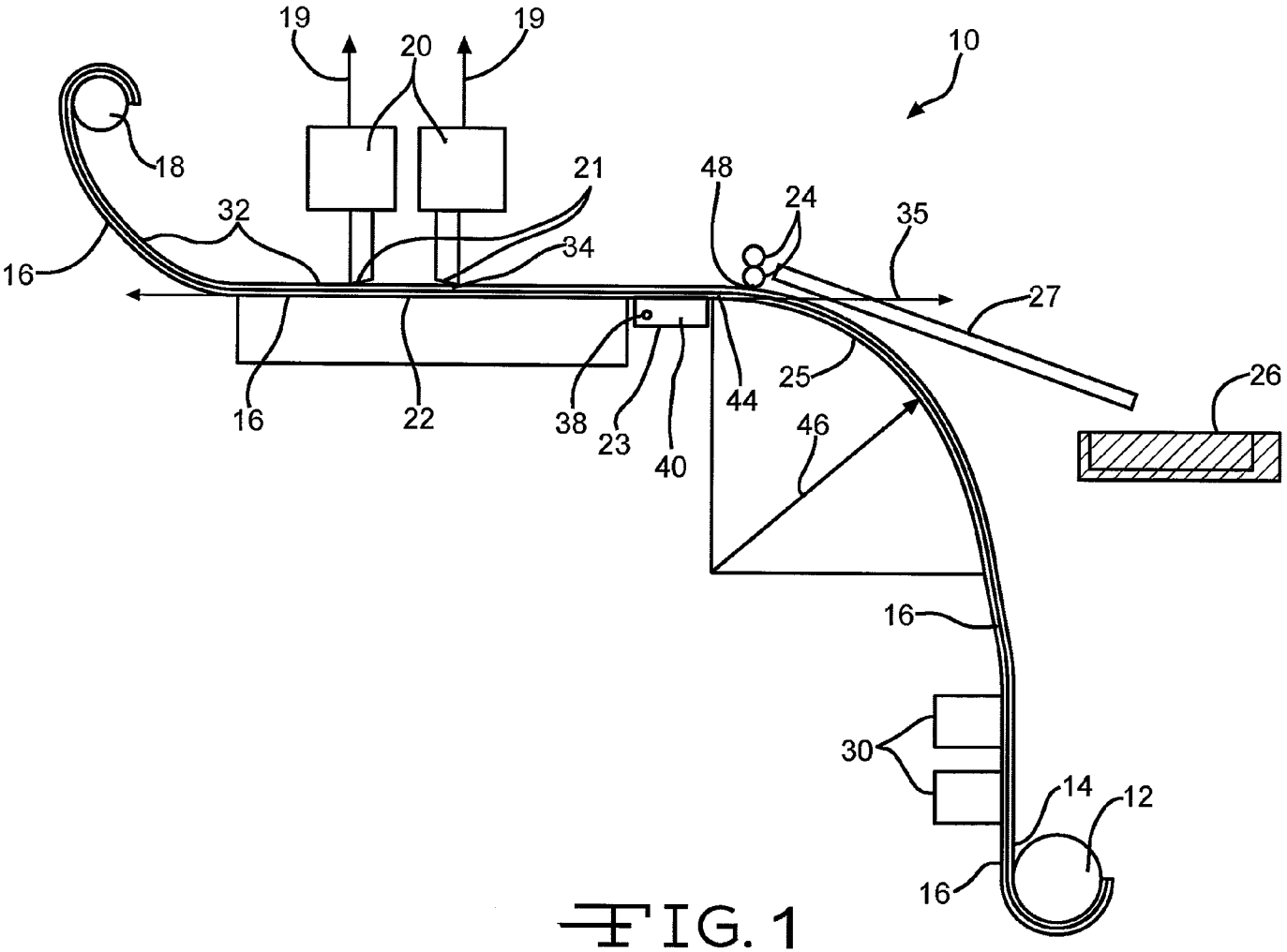
FIG. 1 shows a front view of one embodiment of an apparatus for preparing/processing a cassette spool with cut tape material on original backing paper wound around the cassette spool.

FIG. 1 shows a front view of one embodiment of an apparatus 10 for preparing/processing a cassette spool 12 with cut tape material 14 on original backing paper 16 wound around the cassette spool 12. Whenever the term 'tape material' is used herein, the 'tape material' may comprise for example and without limitation a composite prepeg (pre-impregnated with resin) tape, a graphite, ceramic, aramid, glass, a unidirectional tape material, or other tape material. The apparatus 10 may comprise a supply reel 18, one or more cutting members 20, a cutting surface 22, a pivoting path member 23, a curved path member 25, one or more removing members 24, a scrap slide member 27, a scrap bin 26, an identification member 30, and the cassette spool 12. The supply reel 18 may be adapted to supply and unroll uncut tape material 32 which is on original backing paper 16 and wound around the supply reel 18. In one embodiment, the unrolled uncut tape material 32 may be 1.5 inches to 12 inches wide. In other embodiments, the unrolled uncut tape material 32 may be of varying shapes, sizes, and configurations.

In FIG. 1, the one or more cutting members 20, which may each comprise at least one sharp cutting edge 21, are shown in positions disposed against tape material 32 which is still on original backing paper 16. In other embodiments, the one or more cutting members 20 may comprise a blade, a knife such as an ultrasonic knife, a stylus knife, or other type of knife. In these or other positions, the one or more cutting members 20 are adapted to cut a portion 34 of the tape material 32 to obtain cut tape material 14 in a pre-determined configuration while it is still on the original backing paper 16, without cutting off the original backing paper 16 from the cut portion 34. The cutting surface 22, which may comprise a platen, may be defined in a plane 35. The cutting surface 22 may be disposed adjacent the one or more cutting members 20, and may be adapted to be pressed against the original backing paper 16 as the one or more cutting members 20 cut portion 34 of the tape material 32.

Figure 2:
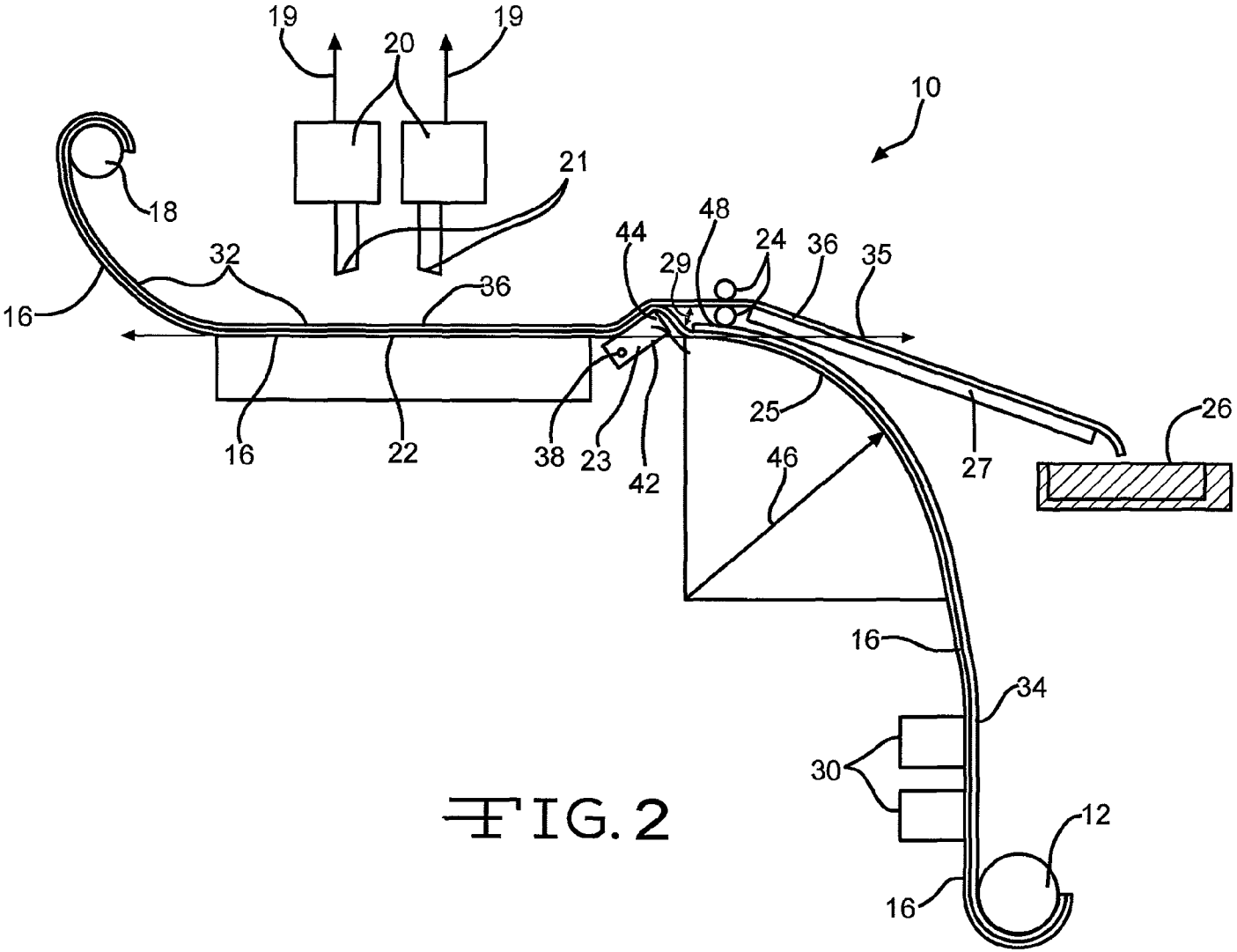
FIG. 2 shows a front view of the embodiment of FIG. 1 with the pivoting path member of the apparatus moved into a different position.

As shown in FIG. 2, after cutting portion 34, the cutting members 20 are adapted to be moved upwardly along direction 19 in order to disengage from cut portion 34. This may allow another scrap portion 36 of the tape material 32, with the original backing paper 16 still on it, to pass by the cutting members 20 without being cut. Subsequently, the cutting members 20 may be adapted to be moved downwardly and upwardly along direction 19 at various times in order to engage and disengage from tape material 32 in order to selectively cut portions 34, as shown in FIG. 1, and selectively not cut scrap portions 36, as shown in FIG. 2. The cut portion 34 of tape material 14 on the original backing paper 16 may move along the cutting surface 22 to and along the pivoting path member 23.

The pivoting path member 23 may comprise a separation bar which is adapted to pivot about a pivot point 38 from a first position 40 aligned in the plane 35, as shown in FIG. 1, to a second position 42, as shown in FIG. 2, in which at least a start portion 44 of the pivoting path member 23 is aligned out of the plane 35. As shown in FIG. 1, the pivoting path member 23 may be adapted to be in the first position 40 when the cut portion 34 of the tape material 14 on the original backing paper 16 is passing along the pivoting path member 23. While in this position, the cut portion 34 of the tape material 14 moving along the pivoting path member 23 may be retained on the original backing paper 16. This is due to the pivoting path member 23 being aligned in the plane 35, resulting in the cut portion 34 of tape material 14 not distorting and not separating from the backing paper 16.

As shown in FIG. 1, the cut portion 34 of tape material 14 on the original backing paper 16 may move from the pivoting path member 23 to and along the curved path member 25, which may comprise a radius block member in a fixed position. At least a start portion 44 of the curved path member 25 may be aligned in the plane 35. The curved path member 25 may have a radius of curvature 46 of at least 12 inches. While moving along the curved path member 25, the cut portion 34 of tape material 14 may be retained on the original backing paper 16, due in part to the relatively low radius of curvature 46 of the curved path member 25. The cut portion 34 of tape material 14 may move in-between a bottom portion 48 of the removing member 24, which may comprise a set of rotating pinch rollers in a fixed location (i.e. rotating, but in a fixed x, y, z position), and the curved path member 25. In such manner, the cut portion 34 of tape material 14 may be held in place against the curved path member 25. However, the bottom portion 48 of the removing member 24 does not need to apply any force to maintain the movement of the cut portion 34 of tape material 14 over the curved path member 25.

As shown in FIG. 1, the cut portion 34 of tape material 14 may move from the curved path member 25 to an identification member 30. The identification member 30, which may comprise a hole punch, a marking device, or other type of identification member, may be adapted to identify, on the original backing paper 16, a start of the cut portion 34 of tape material 14. For instance, a hole may be punched in, or a mark may be made on the original backing paper 16 to signify the start of cut portion 34 of tape material 14. The cassette spool 12 may be adapted to roll up the cut portion 34 of tape material 14 on the original backing paper 16. After the cut portion 34 of tape material 14 on the original backing paper 16 has been rolled onto the cassette spool 12, the identification marks on the original backing paper 16, made by the identification member 30, may allow a user of the cassette spool 12 to know where the cut portion 34 begins. In such manner, the cut portion 34 of tape material 14 of the cassette spool 12 may subsequently be unrolled from the cassette spool 12 in the appropriate location on a working surface.

After the cut portion 34 of tape material 14 has moved past the bottom portion 48 of the removing member 24 and the curved path member 25 and is moving along the curved path member 25, the pivoting path member 23 may pivotally move into the second position 42 shown in FIG. 2. In this position, at least a start portion 44 of the pivoting path member 23 may be aligned out of the plane 35. The cut portion 34 of tape material 14 may finish moving along and over the pivoting path member 23 in the second position 42 while being retained on the original backing paper 16. The cut portion 34 of tape material 14 may not separate from the original backing paper 16 due to the bottom portion 48 of the removing member 24 and the curved path member 25 pressing the cut portion 34 against the original backing paper 16. As a result, both the cut portion 34 of tape material 14 and the non-separated original backing paper 16 pass over the pivoting path member 23. In other embodiments, the cut portion 34 of tape material 14 may not separate from the original backing paper 16 even without force being applied by the bottom portion 48 of the removing member 24.

As shown in FIG. 2, the uncut scrap portion 36 of tape material 32 may pass from the cutting surface 22 and over the pivoting path member 23 in the second position 42. The configuration of the pivoting path member 23 in the second position 42 may force the uncut scrap portion 36 of tape material 32 to separate from the original backing paper 16 due to the abrupt change in path of the tape material 32 as it moves from the pivoting path member 23 to the curved path member 25. The separation angle 29, which may comprise the angle 29 of separation of the uncut scrap portion 36 of the tape material 32 as it separates from the backing paper 16, may be in the range of 5 to 20 degrees. The separated uncut scrap portion 36 of tape material 32, which has been removed from the original backing paper 16, may then move along the removing member 24 to the scrap slide member 27 and be deposited and held in the scrap bin 26. In one embodiment, the separated uncut scrap portion 36 of tape material may through a removing member 24 comprising a set of pinch rollers. As a result, the uncut portion of tape material 32 may be removed from the original backing paper 16 prior to the original backing paper 16, with the cut portion 34 still on it, being rolled onto the cassette spool 12.

Figure 3:
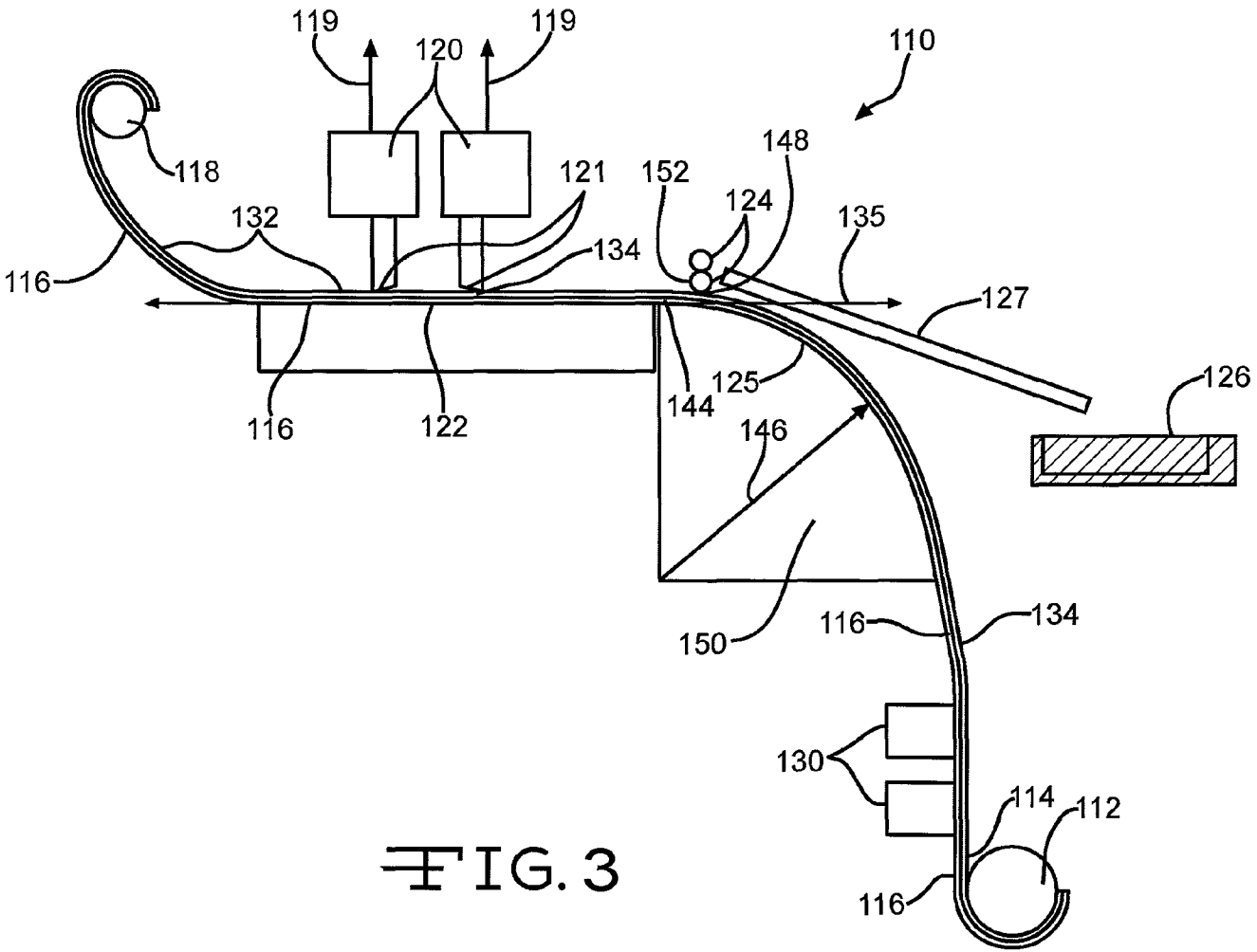
FIG. 3 shows a front view of another embodiment of an apparatus for preparing/processing a cassette spool with cut tape material on original backing paper wound around the cassette spool.

FIG. 3 shows a front view of another embodiment of an apparatus 110 for preparing/processing a cassette spool 112 with cut tape material 114 on original backing paper 116 wound around the cassette spool 112. The apparatus 110 may comprise a supply reel 118, one or more cutting members 120, a cutting surface 122, a curved path member 125, one or more removing members 124, a scrap slide member 127, a scrap bin 126, an identification member 130, and the cassette spool 112. The only differences from the embodiment of FIG. 1 is that instead of using a pivoting path member 23, a fixed in position curved path member 25, and a fixed in position removing member 24, the embodiment of FIG. 3 eliminates the pivoting path member 23 and instead uses a moving curved path member 125 along with moving removing members 124. Everything else regarding the two embodiments may be identical to similarly functioning portions, including the supply reel 118, the cutting members 120, the cutting surface 122, the scrap slide member 127, the scrap bin 126, the identification member 130, and the cassette spool 112, and these components may comprise any of their embodiments disclosed in the discussion of the embodiment of FIG. 1.

As shown in FIG. 3, after the tape 132 is unrolled from the cassette spool 112 and cut into portion 134 on the original backing paper 116, the cut portion 134 of tape material 114 on the original backing paper 116 may move along the cutting surface 122 to and along the curved path member 125 aligned in the first position 150. The curved path member 125 may comprise a moving radius block member having a radius of curvature 146 of at least 12 inches.

While in the first position 150, a start portion 144 of the curved path member 125 may be aligned in the plane 135 in which the cutting surface 122 is defined. The alignment of the start portion 144 of the curved path member 125 with the plane 135 of the cutting surface 122 may force the cut portion 134 of tape material 114 to remain on the original backing paper 116 as it moves from the cutting surface 122 and along the curved path member 125. This is due to the cut portion 134 of tape material 114 not distorting and not separating from the backing paper 116 as a result of the non-abrupt path from the cutting surface 122 to the start portion 144 of the curved path member 125.

While moving along the curved path member 125, the cut portion 134 of tape material 114 may be retained on the original backing paper 116, due in part to the relatively low radius of curvature 146 of the curved path member 125. The cut portion 134 of tape material 114 may move in-between a bottom portion 148 of the removing member 124 in its position 152 shown in FIG. 1, which may comprise a set of pinch rollers, and the curved path member 125. In such manner, the cut portion 134 of tape material 114 may be held in place against the curved path member 125. However, the bottom portion 148 of the removing member 124 does not need to apply any force to maintain the movement of the cut portion 134 of tape material 114 over the curved path member 125.

The cut portion of tape material 114 may move from the curved path member 125 to the identification member 130 which may identify on the original backing paper 16, a start of the cut portion 134 of tape material 114. The cassette spool 112 may then roll up the cut portion 134 of identified tape material 114 on the original backing paper 116.

Figure 4:
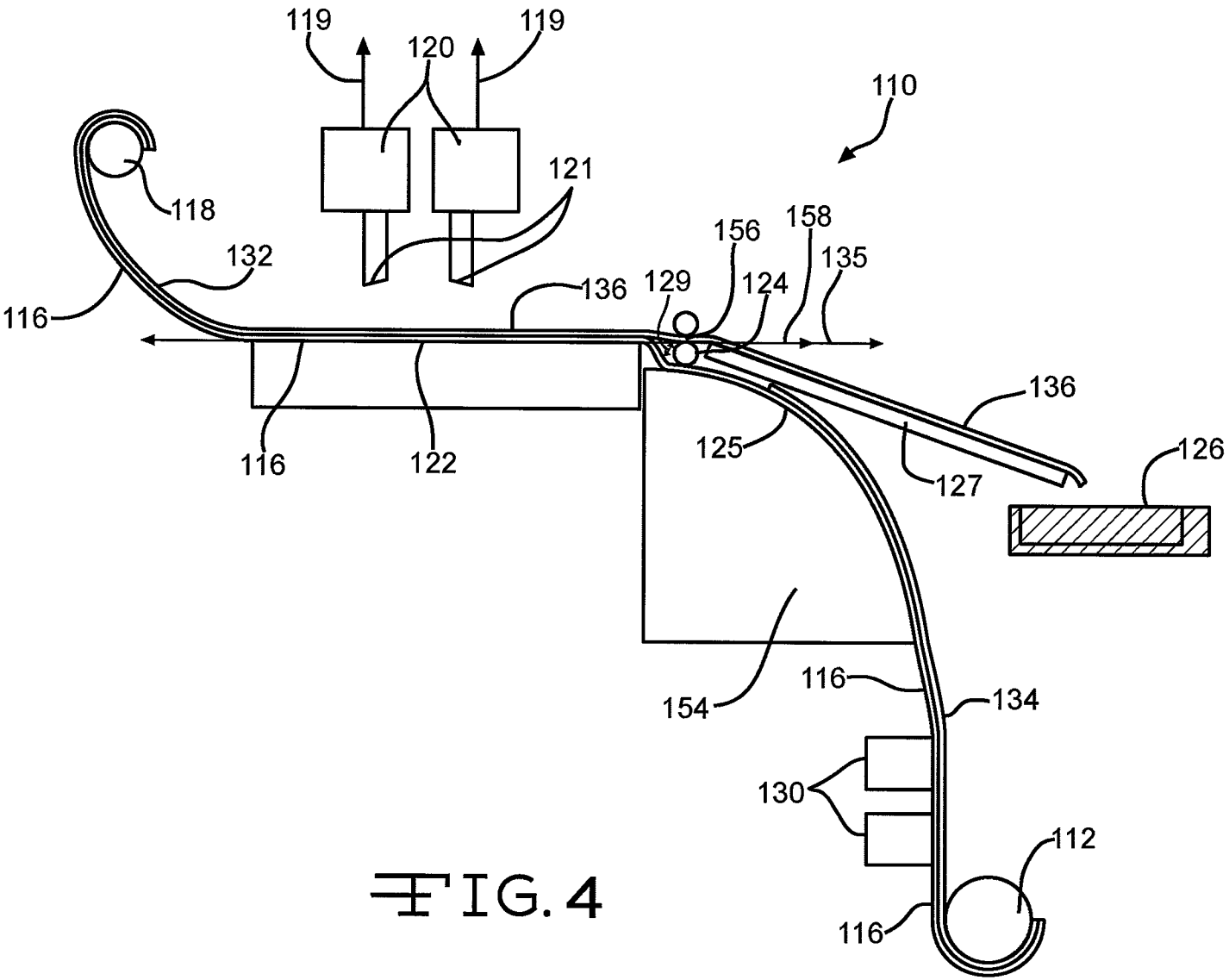
FIG. 4 shows a front view of the embodiment of FIG. 3 with the curved path member and the removing member of the apparatus moved into different positions.

After the cut portion 134 of tape material 114 has moved past the bottom portion 148 of the removing member 124 and the curved path member 125 and is moving along the curved path member 125, the curved path member 125 and removing member 124 may move downwardly into their second positions 154 and 156 shown in FIG. 4. In these positions, the start portion 144 of the curved path member 125 may be aligned out of the plane 135 in which the cutting surface 122 is defined, while a center axis 158 running through the removing member 124 may be aligned in the plane 135. The cut portion 134 of tape material 114 may finish moving along and over the curved path member 125 in its second position 154 while being retained on the original backing paper 116. The cut portion 134 of tape material 114 may not separate from the original backing paper 116 due to the bottom portion 148 of the removing member 124 and the curved path member 125 pressing the cut portion 134 against the original backing paper 116. However, the bottom portion 148 of the removing member 124 does not need to apply any force to maintain the movement of the cut portion 134 of tape material 114 over the curved path member 125.

The uncut scrap portion 136 of tape material 132 may then pass from the cutting surface 122 and through the center axis 158 of the removing member 124 which is aligned with the plane 135. The configuration of the curved path member 125 and the removing member 124 in their second positions 154 and 156 may force the uncut scrap portion 136 of tape material 132 to separate from the original backing paper 116 due to the abrupt change in path of the tape material 132 as it moves from the cutting surface 122 to the curved path member 125. The separation angle 129, which may comprise the angle 129 of separation of the uncut scrap portion 136 of the tape material 132 as it separates from the backing paper 116, may be in the range of 5 to 20 degrees. The separated uncut scrap portion 136 of tape material 132, which has been removed from the original backing paper 116, may then move along the removing member 124 to the scrap slide member 127 and be deposited and held in the scrap bin 126. In one embodiment, the separated uncut scrap portion 136 of tape material 132 may move through a removing member 124 comprising a set of pinch rollers. As a result, the uncut portion of tape material 132 may be removed from the original backing paper 116 prior to the original backing paper 116, with the cut portion 134 still on it, being rolled onto the cassette spool 112.

Figure 5:
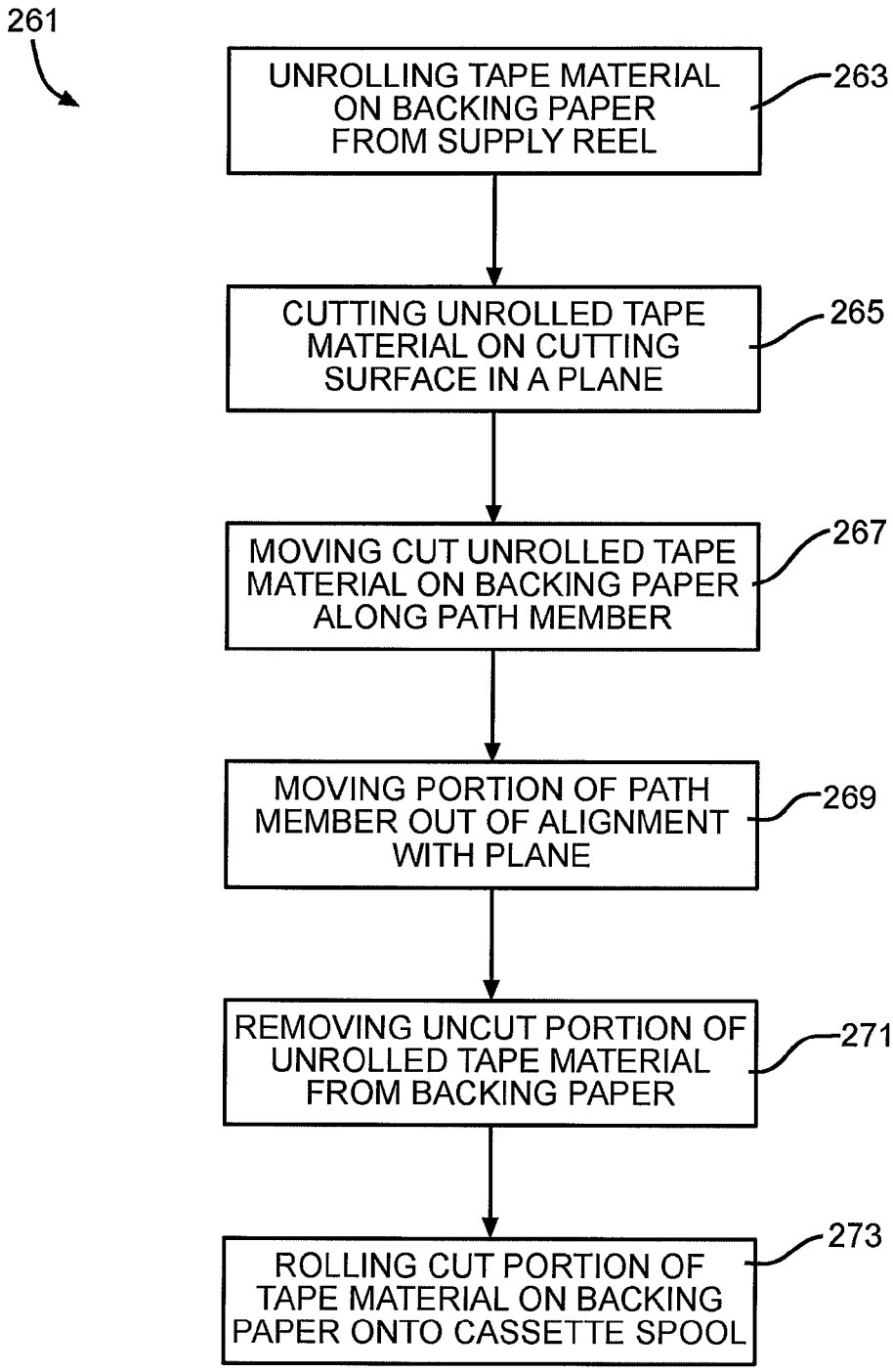
FIG. 5 is a flowchart showing one embodiment of a method for preparing a cassette spool with cut tape material on original backing paper wound around the cassette spool.

FIG. 5 shows a flowchart 261 of an embodiment of a method for preparing a cassette spool with cut tape material on original backing paper wound around the cassette spool. In one embodiment, the tape material may comprise composite tape. In another embodiment, the tape material may comprise unidirectional composite tape made of Kevlar, Graphite, Fiberglass, or other type of material. In still another embodiment, the tape material may comprise a prepeg composite tape. In one embodiment, the original backing paper may comprise a polymeric matrix material made of Paper, Polyster, Mylar, Tedlar, Polyurethane, or other type of material, such as a paper coated with a release material. In one step 263, tape material on original backing paper may be unrolled from a supply reel.

In another step 265, a portion of the unrolled tape material, which may still be on the original backing paper, may be cut on a cutting surface defined in a plane. In one embodiment, this step 265 may comprise cutting the portion of unrolled tape material using a cutting member having a sharp edge, while the original backing paper is against the cutting surface which may comprise a platen. In yet another step 267, the cut portion of unrolled tape material may be moved along a path member while retaining the cut portion of unrolled tape material on the original backing paper. At least a start of the path member may be aligned in the plane. The path member may comprise a pivoting path member which may comprise a separation bar. In another embodiment, the path member may be curved, such as a curved radius block with a radius of curvature of at least 12 inches. In yet another embodiment, a further step may comprise moving the cut portion of unrolled tape material along a curved path member which is fixed in position.

In another step 269, at least a portion of the path member may be moved out of alignment with the plane to facilitate separation of an uncut portion of the unrolled tape material from the original backing paper. This step may further comprise abutting the path member against the original backing paper of the uncut portion of the unrolled tape material. In yet another step 271, the uncut portion of the unrolled tape material may be removed from the original backing paper. In one embodiment, this step may further comprise moving the uncut portion of the unrolled tape material along at least one rolling member, down a scrap slide member, and into a scrap bin.

In another embodiment, a further step may comprise identifying a start of the portion of cut unrolled tape material on the original backing paper. In one embodiment, this may comprise using at least one of a hole punch, a marking device, such as a pen, or other identifying device to identify on the original unrolled backing paper the start of the cut portion. In an additional step 273, the cut portion of unrolled tape material, which may still be on the original backing paper, may be rolled onto the cassette spool to form wound cut tape material. In yet another embodiment, an additional step may comprise unrolling the wound cut tape material, still on the original backing paper, from the cassette spool to place the cut portion of tape material onto a working surface using a flat tape placement machine, a contoured tape laminating machine, or other type of tape placement machine.

One or more embodiments of the disclosure may reduce and/or eliminate one or more problems which may have been experienced by one or more of the existing apparatus or methods. For instance, one or more embodiments of the disclosure may reduce the numbers and amounts of backing paper needed, may reduce costs, may reduce the number of machines required, may substantially reduce time since the process may be carried out without transferring cut tape to new backing paper, may lead to less wrinkling and/or tension in the tape material against the backing paper since new backing paper is not required, may improve the adherence of the cut tape to the backing paper since new backing paper is not required, may reduce tacking problems, may reduce problems in transferring tape resin to new backing paper, may improve efficiency, may be less complex, may be more reliable, may be more accurate, may make it less difficult to place tape against working surfaces by providing improved tracking and guidance, may reduce tape lifting from working surfaces, and/or may reduce and/or eliminate one or more other types of problems in one or more of the existing apparatus and/or methods.

Figure 6:
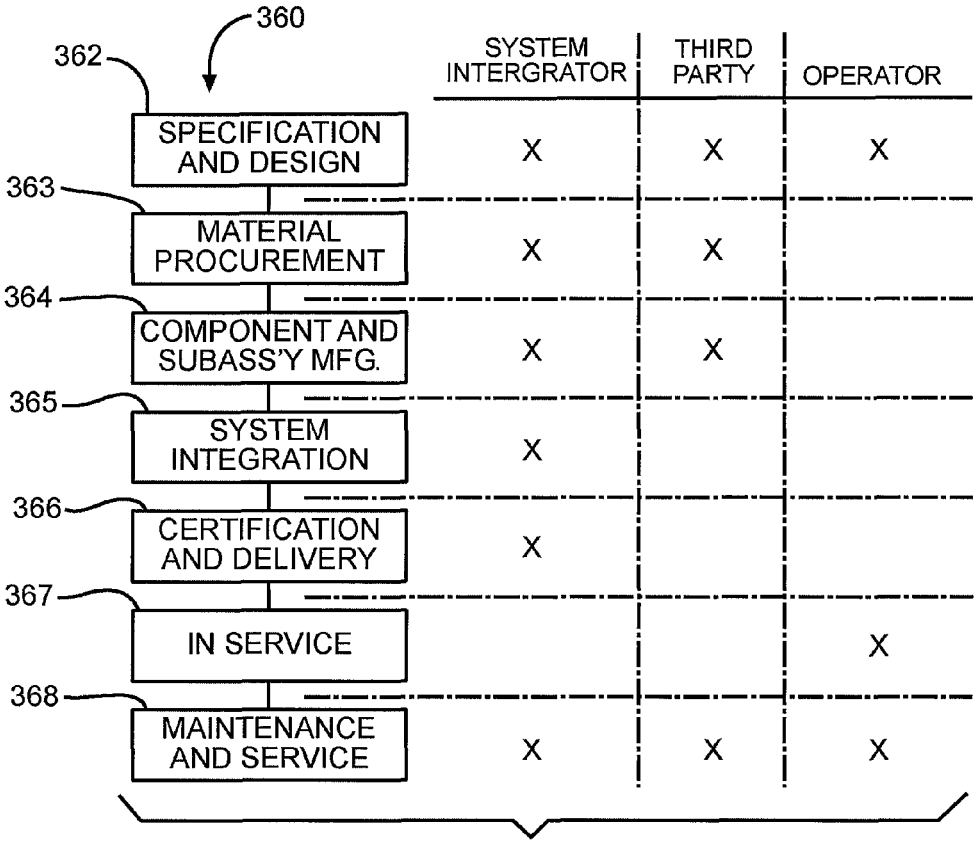
FIG. 6 is a flow diagram of an aircraft production and service methodology.
Figure 7:
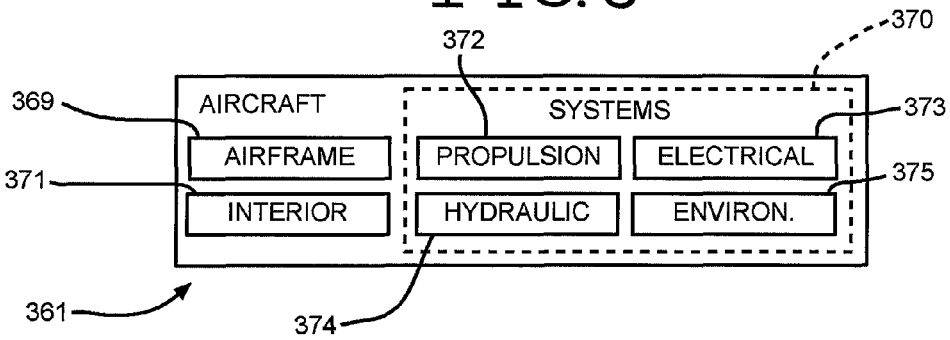
FIG. 7 is a block diagram of an aircraft.

Referring more particularly to the drawings, embodiments of the disclosure may be described in the context of an aircraft manufacturing and service method 360 as shown in FIG. 6 and an aircraft 361 as shown in FIG. 7. During pre-production, exemplary method 360 may include specification and design 362 of the aircraft 361 and material procurement 363. During production, component and subassembly manufacturing 364 and system integration 365 of the aircraft 361 takes place. Thereafter, the aircraft 361 may go through certification and delivery 366 in order to be placed in service 367. While in service by a customer, the aircraft 361 is scheduled for routine maintenance and service 368 (which may also include modification, reconfiguration, refurbishment, and so on).

Each of the processes of method 360 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 7, the aircraft 361 produced by exemplary method 360 may include an airframe 369 with a plurality of systems 370 and an interior 371. Examples of high-level systems 370 include one or more of a propulsion system 372, an electrical system 373, a hydraulic system 374, and an environmental system 375. Any number of other systems may be included. Although an aerospace example is shown, the principles of the invention may be applied to other industries, such as the automotive industry.

Apparatus and methods embodied herein may be employed during any one or more of the stages of the production and service method 360. For example, components or subassemblies corresponding to production process 364 may be fabricated or manufactured in a manner similar to components or subassemblies produced while the aircraft 361 is in service. Also, one or more apparatus embodiments, method embodiments, or a combination thereof may be utilized during the production stages 364 and 365, for example, by substantially expediting assembly of or reducing the cost of an aircraft 361. Similarly, one or more of apparatus embodiments, method embodiments, or a combination thereof may be utilized while the aircraft 361 is in service, for example and without limitation, to maintenance and service 368.

It should be understood, of course, that the foregoing relates to exemplary embodiments of the disclosure and that modifications may be made without departing from the spirit and scope of the disclosure as set forth in the following claims.

The invention claimed is:

1. An apparatus for preparing a cassette spool comprising:

a supply reel for supplying and unrolling tape material on original backing paper;

at least one cutting member for cutting unrolled tape material while on original backing paper;

a cutting surface defined in a plane, the cutting member and cutting surface configured to cooperate so as to cut a portion of unrolled tape material to form a cut portion and an uncut portion;

a pivoting path member adapted to move from a first position aligned in the plane to a second position in which at least a portion of the pivoting path member is aligned out of the plane, the cut portion and the uncut portion of the unrolled tape material configured to pass over the pivoting path member, the uncut portion separating from the backing material of the unrolled tape material when passing over the pivoting path member in the second position;

a curved path member;

at least one removing member configured such that the uncut tape material removed from the original backing paper at the pivoting path member is fed into the removing member and the cut portion of the unrolled tape material is fed between and against the removing member and one of the pivoting path member and the curved path member; and a cassette spool for rolling up unrolled cut tape material on original backing paper.

2. The apparatus of claim 1 further comprising an identification member for identifying on unrolled original backing paper a start of unrolled cut tape material.

3. The apparatus of claim 2 wherein the identification member comprises at least one of a hole punch, and a marking device for identifying on original unrolled backing paper a start of cut unrolled tape.

4. The apparatus of claim 1 wherein said at least one cutting member comprises at least one sharp cutting edge.

5. The apparatus of claim 1 wherein the cutting surface comprises a platen.

6. The apparatus of claim 1 wherein said at least one removing member comprises at least one rolling member.

7. The apparatus of claim 1 wherein the apparatus further comprises a scrap bin for holding removed uncut unrolled tape material.

8. The apparatus of claim 1 wherein the apparatus further comprises a scrap slide member.

9. The apparatus of claim 1 further comprising the curved path member in a fixed position, wherein at least a start portion of the curved path member is aligned in the plane.

10. The apparatus of claim 9 wherein the curved path member comprises a radius of curvature of at least 12 inches.

11. The method of claim 9 wherein the curved path member is a radius block member.

12. The apparatus of claim 1 wherein in the second position a separation angle of the uncut portion of the unrolled tape material relative to the original backing paper is substantially in the range of 5 to 20 degrees.

13. The apparatus of claim 1 wherein the pivoting path member is a separation bar.

14. An apparatus for preparing a cassette spool comprising:

a supply reel for supplying and unrolling tape material on original backing paper;

at least one cutting member for cutting unrolled tape material while on original backing paper;

a cutting surface defined in a plane, the cutting member and cutting surface configured to cooperate so as to cut a portion of unrolled tape material to form a cut portion and an uncut portion;

a pivoting path member adapted to move from a first position aligned in the plane to a second position in which at least a portion of the pivoting path member is aligned out of the plane, the cut portion and the uncut portion of the unrolled tape material configured to pass over the pivoting path member, the uncut portion separating from the backing material of the unrolled tape material when passing over the pivoting path member in the second position;

a curved path member in a fixed position, wherein at least a start portion of the curved path member is aligned in the plane at least one removing member configured such that the uncut tape material removed from the original backing paper at the pivoting path member is fed into the removing member and the cut portion of the unrolled tape material is fed between and against the removing member and one of the pivoting path member and the curved path member; and a cassette spool for rolling up unrolled cut tape material on original backing paper.

15. The apparatus of claim 14 further comprising an identification member for identifying on unrolled original backing paper a start of unrolled cut tape material.

16. The apparatus of claim 14 wherein said at least one cutting member comprises at least one sharp cutting edge.

17. The apparatus of claim 14 wherein the cutting surface comprises a platen.

18. The apparatus of claim 14 wherein said at least one removing member comprises at least one rolling member.

19. The apparatus of claim 14 wherein the apparatus further comprises a scrap bin for holding removed uncut unrolled tape material.

20. The apparatus of claim 14 wherein in the second position a separation angle of the uncut portion of the unrolled tape material relative to the original backing paper is substantially in the range of 5 to 20 degrees.

* * * * *